United States Patent [19]

Timoshenko et al.

[11] Patent Number: 4,495,381

[45] Date of Patent: Jan. 22, 1985

[54] DYNAMIC LOAD BEARING TRANSMISSION LINE SUPPORT MEMBER

[75] Inventors: John A. Timoshenko, Pittsfield; Daniel D. Bergh, Lenox, both of Mass.

[73] Assignee: General Electric Company, Pittsfield, Mass.

[21] Appl. No.: 429,712

[22] Filed: Sep. 30, 1982

[51] Int. Cl.[3] ..... H01B 17/02; H01B 17/46

[52] U.S. Cl. ..... 174/178; 156/172; 174/140 S

[58] Field of Search ..... 174/140 S, 176, 177, 174/178, 179; 156/172

[56] References Cited

U.S. PATENT DOCUMENTS 2,924,643 2/1960 Barnes ..... 174/178

3,261,910 7/1966 Jacquier ..... 174/178

3,850,722 11/1974 Kreft ..... 156/172

*Primary Examiner*—Laramie E. Askin

*Attorney, Agent, or Firm*—Robert A. Cahill; William Freedman

[57] ABSTRACT

An elongated, insulative tube of high mechanical strength consists of resin bonded glass fibers wound in alternating helical and circumferential winding patterns. The glass fiber convolutions at the outer limits of these winding patterns embrace metallic inserts, securely captivating them within the open ends of the tube. Tapped central bores in these inserts threadedly receive end fittings adapting the tube to a transmission line supporting function. The tube also externally mounts a pair of spaced arcing rings and internally mounts a varistor array for protecting a transmission line against lightning strikes.

7 Claims, 10 Drawing Figures

DYNAMIC LOAD BEARING TRANSMISSION LINE SUPPORT MEMBER

BACKGROUND OF THE INVENTION

The present invention relates generally to a load bearing member, and particularly to an elongated, insulative support member for aerial high voltage transmission lines.

As transmission voltages are increased to ever higher levels, aerial transmission lines must be spaced greater distances from taller transmission line supporting superstructures or towers. This means that the insulators supporting the transmission lines from the towers must be of greater length. Moreover, the dynamic loading on the transmission lines caused by varying weather conditions such as wide variations in temperature, high winds, icing, etc., imposes tremendous physical stresses on the line supporting insulators. Thus, the insulators must be mechanically robust, in addition to being of high dielectric strength, and consequently are quite heavy in weight and difficult to install. In response to these needs, certain types of insulators have been devised using fiberglass rods as the main structural element. Requisite dielectric strength and protection against the elements is provided by elastomeric weathersheds slipped onto these rods in end-to-end relation. The fiberglass rods are designed to withstand the tremendous compressive, tensile, flexure and torsional stresses incident in the dynamic loading imposed on transmission lines. However, the problem remains to join the requisite fittings to the ends of the fiberglass rod which will accommodate physical connections with the transmission line and the tower. The fitting joints with the rod must also withstand the dynamic loading stresses. Experience has shown that these fitting joints are the weak link in the transmission line insulative supporting structure.

It is accordingly an object of the present invention to provide an improved elongated load bearing member of high mechanical strength.

An additional object is to provide a load bearing member of the above character which is formed of electrically insulative material and thus has application in an aerial high voltage transmission line supporting insulator.

Another object is to provide a load bearing member of the above character having improved end fitting joints.

Yet another object of the present invention is to provide a load bearing member of the above character which is efficient in construction, has a high strength-to-weight ratio, and is reliable in service.

Other objects of the invention will in part be obvious and in part appear hereinafter.

SUMMARY OF THE INVENTION

In accordance with the present invention, there is provided a high strength, elongated, load bearing member formed of electrically insulative material and having particular but not necessarily limited application to high voltage transmission line insulators. The load bearing member is in the form of a tube of multiply wound, continuous glass fibers of high tensile strength bonded in a suitable resin, such as epoxy or polyester resin. Captivated in the open ends of the tube are metallic fittings having means facilitating physical connection with hardware items adapting the tube to a particular application. While the detailed description illustrates the tube being utilized in a combination strut insulator and lightning arrester for supporting and protecting a high voltage transmission line, it will be appreciated that the tube may be readily adapted to other insulative support applications calling for an elongated load bearing member of high mechanical strength and light weight.

More specifically, the tube of the present invention is constructed by winding continuous glass fibers onto a mandrel in alternating helical and circumferential winding patterns. As wound, the glass fibers are liberally coated with a resin bonding agent which is ultimately cured to a hardened state ultimately bonding the differentially wound glass fiber convolutions together in creating a solid tube sidewall. The glass fiber convolutions are extended over and beyond metallic inserts mounted in spaced relation on the mandrel, such that, upon curing of the resin bonding agent, the inserts are captivated within the open ends of the tube in interference fit fashion, thereby achieving a tube-insert joint virtually as strong as the tube itself, insofar as most applications are concerned.

For a full understanding of the nature and objects of the present invention, reference should be had to the following detailed description taken in conjunction with the accompanying drawings, in which.

Corresponding reference numerals refer to like parts throughout the several views of the drawings.

DETAILED DESCRIPTION

Figure 1:
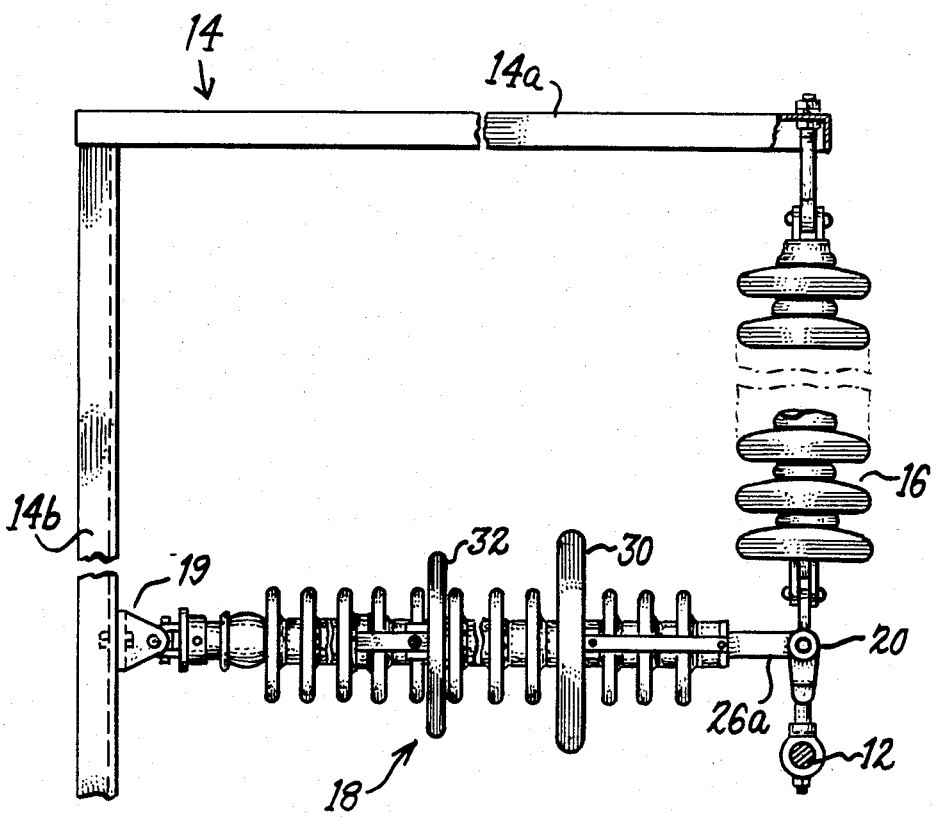
FIG. 1 is a fragmentary elevational view of the combination strut insulator and lightning arrester or "strut arrester" shown supporting a transmission line from a transmission tower.

Referring first to FIG. 1, there is shown a transmission line 12 supported from a superstructure or tower, generally indicated at 14, by a conventional suspension insulator string 16, depended from a tower crossarm 14*a*, and a combination strut insulator and lightning arrester or "strut arrester", generally indicated at 18 and constructed in accordance with the present invention. Strut arrester 18 is mechanically connected to a tower upright 14*b* via a conventional universal joint fitting 19. To insure electrical continuity between the strut arrester and the tower, if metal, or a ground cable through the universal joint, a conductive metal link (not shown) is installed. The other end of the strut arrester is connected with suspension insulator 16 and transmission line 12 by conventional hardware indicated at 20.

Figure 2:
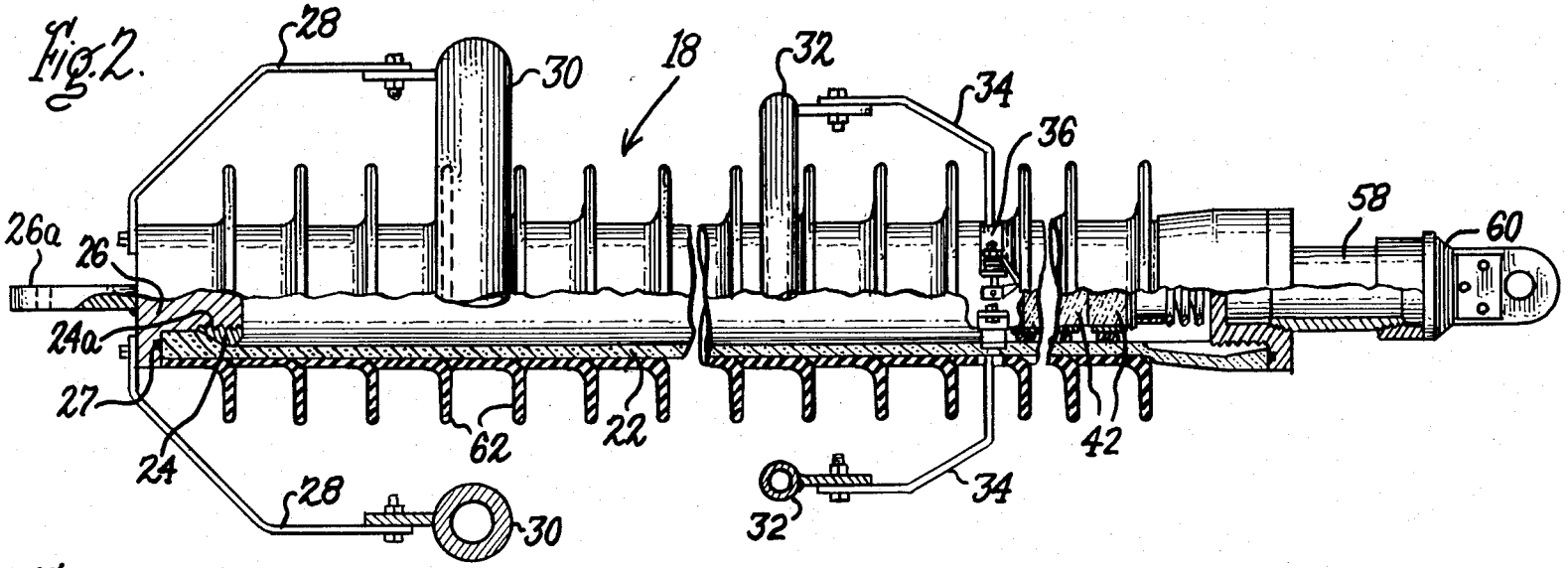
FIG. 2 is an enlarged side view, fragmented and partially broken away, of the strut arrester of FIG. 1.
Figure 6:
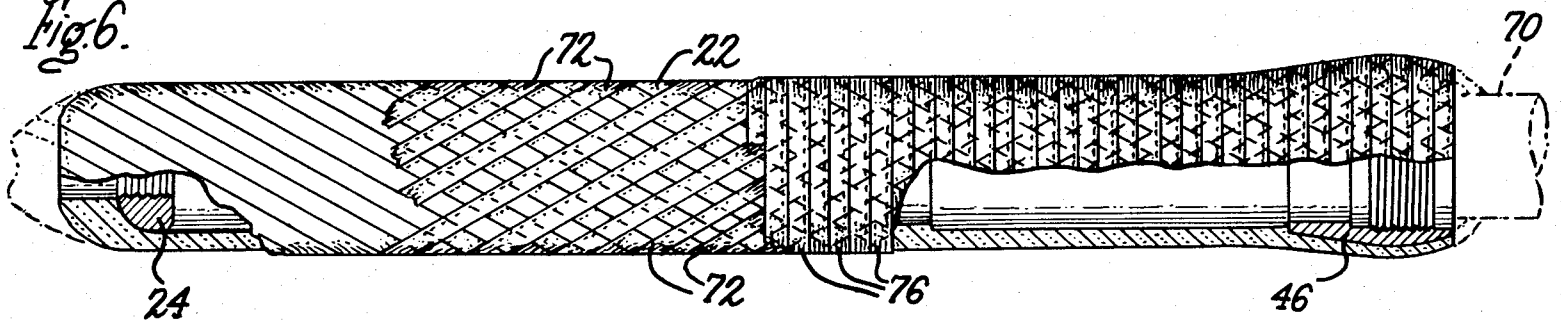
FIG. 6 is a longitudinal view, partially broken away, of the insulative tube utilized in the strut arrester of FIG. 1.
Figure 7:
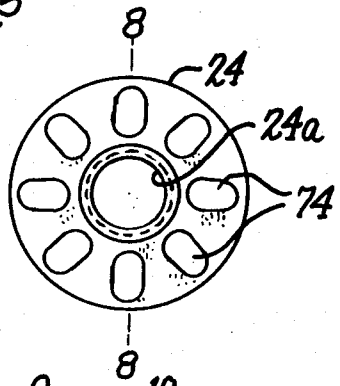
FIG. 7 is an end view of a metal insert affixed in one end of the tube of FIG. 6.
Figure 9:
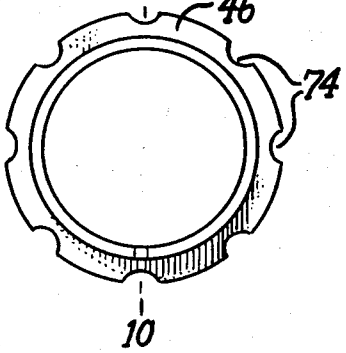
FIG. 9 is an end view of a metal insert affixed in the other end of the tube of FIG. 6.

Strut arrester 18, best seen in FIG. 2, includes an elongated, insulative tube 22 of high mechanical strength whose construction will be detailed in conjunction with FIG. 6. Affixed in the line end of the tube is a metal insert fitting 24, which is seen in FIGS. 6 and 7 to have a truncated conical shape with a central threaded bore 24*a*. Into this bore is threaded a metal end fitting 26 having an apertured tang 26*a* for pivotal connection to hardware 20, as seen in FIG. 1. An O-ring 27 on a radially-extending shoulder of the end fitting provides an airtight seal between the insert and end fitting when the shoulder abuts the end wall of tube 22. Bolted to end fitting 26 are a pair of bracket arms 28 serving to mount an annular arcing ring 30 encompassing the strut arrester body at a location spaced inwardly of its line end.

Figure 4:
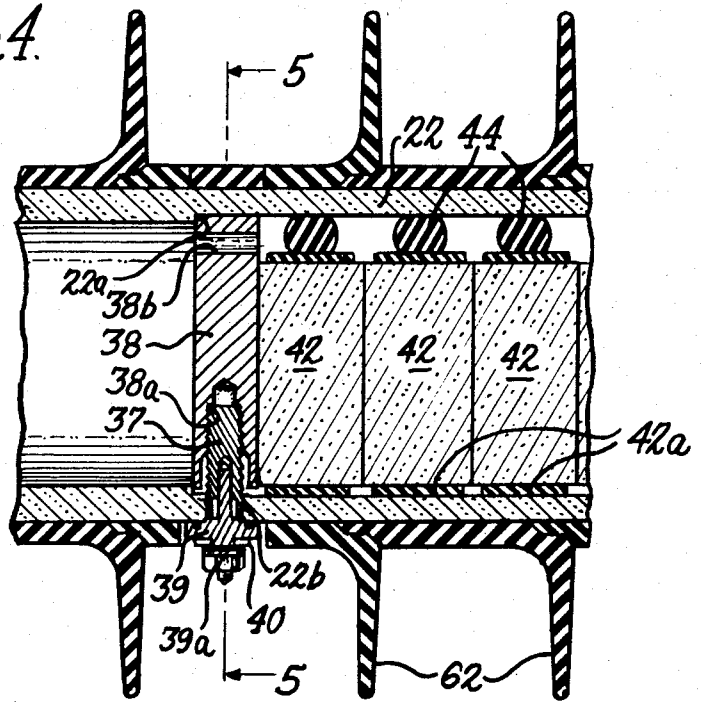
FIG. 4 is a fragmentary, longitudinal sectional view of an intermediate portion of the strut arrester of FIG. 1.
Figure 5:
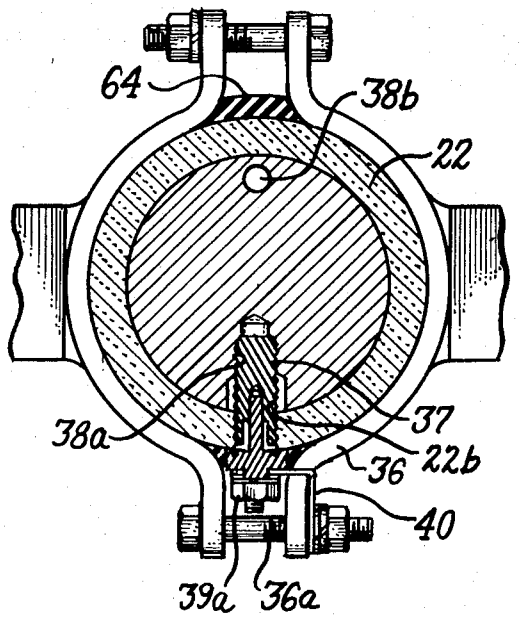
FIG. 5 is a sectional view taken along line 5—5 of FIG. 4, with the arcing ring mounting bracket added.

Referring jointly to FIGS. 2, 4 and 5, a second annular arcing ring 32 is mounted by bracket arms 34 which are carried by a clamp 36 secured in embracing relation with tube 22 at a location intermediate its ends. The two arcing rings are thus disposed in spaced relation to define an arc gap therebetween. As best seen in FIG. 4, a circular contact member 38, inserted into tube 22 from the tower end, is seated against an annular shoulder 22*a* created in the tube bore. A threaded, radially extending blind hole 38*a* in the contact member receives a threaded plug 37 introduced through a hole 22*b* in the tube sidewall. The plug, in turn, has a tapped axial bore to accept a threaded inner stem of an electrical terminal post 39. An outer threaded stem of this post accepts a nut 39*a* which clamps down on one end of a conductive strap 40. The other end of this strap is secured in electrical connection with clamp 36 and thus arcing ring 32 by one of the clamp securing bolts 36*a*, as seen in FIG. 5. Appropriate provisions are made to provide an airtight seal round hole 22*b* in the tube sidewall.

From the description thus far, it is seen that transmission line 12 and contact member 38 are included in a series circuit including the arcing rings and the spark gap created therebetween.

Figure 3:
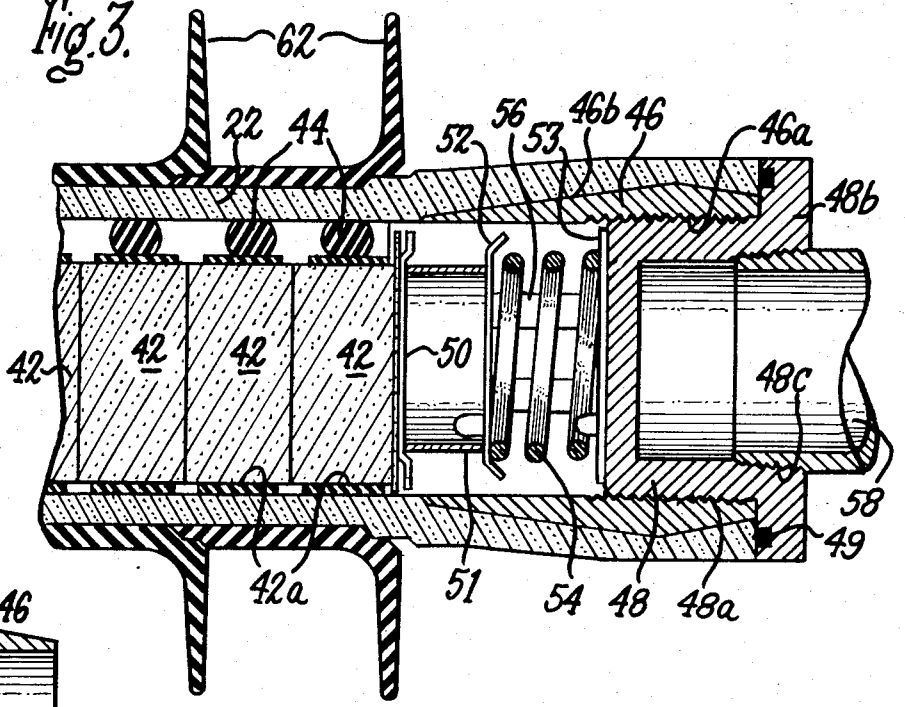
FIG. 3 is a fragmentary, longitudinal sectional view of the tower end portion of the strut arrester of FIG. 1.
Figure 8:
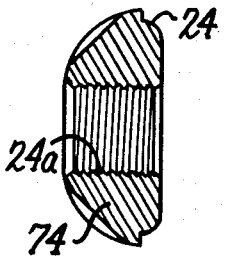
FIG. 8 is a sectional view taken along line 8—8 of FIG. 7.
Figure 10:
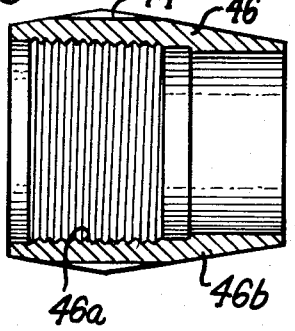
FIG. 10 is a sectional view taken along line 10—10 of FIG. 9.

From contact member 38 to just short of the tower end of strut arrester 18, the interior of tube 22 is packed with a series array of zinc oxide varistors 42, as seen in FIGS. 2, 3 and 4. These varistors are of known construction, having a sintered disc-shaped body and electrodes applied to their opposed faces. Thus, when stacked together as shown, the electrodes of adjacent varistors are in electrical contacting engagement, while the varistor electrode at the line end of the stack is in electrical contacting engagement with contact member 38. The varistor discs are collared with elastomeric sleeves 42*a* and are biased against the tube sidewall by discrete resilient balls 44 for mounting and heat sinking purposes as disclosed in commonly assigned U.S. Pat. No. 4,092,694.

Referring to FIG. 3, there is affixed in the tower end of tube 22 a metal insert 46 in the general shape of a sleeve having a threaded internal bore 46*a* and a crowned exterior surface 46*b*, as shown. A cup-shaped end fitting 48 is provided with an external threaded portion 48*a* for engagement in the insert bore to the point where its annular shoulder 48*b* butts against the flush outer ends of the insert and tube. An O-ring 49, accommodated in an annular groove in the underside of shoulder 48*b*, provides an airtight seal between the insert and end fitting. Between end fitting 48 and the end of the varistor stack there is disposed a contact disc 50, a metal sleeve 51, and a pair of centering metallic discs 52 and 53 for an intermediate compression spring 54. This spring compresses the varistor stack to insure good inter-electrode electrical contacting engagement. A conductive foil strip 56, with its ends wrapped about the outermost spring convolutions insures good electrical conductivity between the varistor stack and end fitting 48. A suitable dessicant (not shown) is placed in the available space between the varistor stack and the end fitting, including the interior of sleeve 51, to insure a dry air environment in the tube interior. To this end, conductive member 38 is provided with a vent hole 38*b*, as seen in FIG. 4, so that air in the tube interior beyond the varistor stack can be dried.

Threaded into internal threads 48*c* in end fitting 48 is one end of a metal pipe 58 which, depending on the particular installation, may be several inches to several feet in length. To the other end of this pipe is threaded a conventional hardware fitting 60 appropriate for coupling with the tower-mounted universal joint 19 (FIG. 1).

To protect the strut arrester from the elements and to afford the necessary dielectric strength for high voltage application, a plurality of weathersheds 62 of elastomeric material are slipped onto the exterior of tube 22 in partially overlapped, end-to-end relation covering substantially the entire length of the tube. A circumferential section of one weathershed is cut away to afford clearance for arcing ring mounting clamp 36 to directly embrace the tube, as seen in FIG. 5. To fill the voids between clamp halves, and about terminal post 39, inserts 64 are utilized. Preferably, liberal amounts of silicone grease are applied to the junctions between weathersheds and about terminal post 39 for weather protection.

It is thus seen that the transmission line is connected to ground via the series circuit including the arcing ring spark gap and the varistor stack. At normal transmission line voltages, the spark gap is an open circuit isolating the transmission line from ground. However, when a lightning strike hits either the transmission line or the tower, the spark gap, which may be eighteen inches across, is breeched, and the lightning energy is absorbed by the varistor stack. The illustrated different sizes of the two arcing rings is resorted to in order to reasonably proportion the arcover voltage for lightning strikes to either the tower or the transmission line and of either polarity. It will be appreciated that the installation of the strut arrester may be reversed end for end from that illustrated.

In addition to the above-described lightning arrester function of strut arrester 18, there is also the line supporting function which must contend with wide variations in dynamic and static loading. The brunt of this mechanical loading is borne by tube 22 and the inserts 24 and 46 incorporated in the tube ends. Thus, not only the tube itself but its grip on these inserts must withstand tremendous compressive tensile and, to a lesser extent, torsional and bending stresses. While elongated elements heretofore utilized in line insulator applications are known to have the requisite mechanical strength, the affixation of the end fittings thereto, typically by crimping or gluing, has been their weak point.

Tube 22, as disclosed herein, is constructed in a manner such as to provide not only high body strength and resistance to deformation but also to achieve a tenacious grip on the fittings at each end, specifically inserts 24 and 46. To this end, tube 22 is formed of glass fibers and a suitable fiber bonding resin; the fibers being drawn through a liquid resin bath and wound as a band of plural, continuous strands onto a rotating mandrel indicated in phantom at 70 in FIG. 6. The peripheral surface of the mandrel conforms to the final interior tube surface shown and includes suitable means for establishing the longitudinal positions of inserts 24 and 46. The glass fiber band is wound in alternating, oppositely directed helical convolutions 72 to develop a continuous tubular layer after multiple oppositely directed traverses of the winding equipment. The helix angle may range from 10° to 50°. As an important feature, the glass fibers are wound onto the mandrel outboard of the inserts 24, 46, as illustrated in phantom. In addition, the exterior surfaces of the inserts are notched, as indicated at 74, such that some of the helical convolutions become lodged therein. This constributes to the exceptional torsional strength of the tube-insert joint.

After at least two and up to six or more helical wound tubular layers have been developed, the winding pattern is changed to a circumferential wind, and a continuous tubular layer of virtually circumferential convolutions 76 (helix angle of 85° or more) are wound atop the previously developed multiple helically wound tubular layers. Consecutive convolutions 76 are wound in band abutting or, preferably, slightly overlapping relation.

These circumferential convolutions are likewise wound beyond the ends of the inserts. After developing at least one continuous tubular layer of circumferential convolutions 76, the winding pattern is switched back to the helical wind, and multiple helically wound tubular layers are applied. This alternation between helical and circumferential winding patterns is continued until the tube is built up to the desired wall thickness. The final tubular layer is applied as a circumferential wind, at which time the indicated extra thickness of the tube end beyond insert 24 is developed. Preferably the initial tubular layer is also applied as a circumferential wind. The fully wound tube is subject to a curing cycle to harden the resin bonding agent and the mandrel is removed. Such removal of the mandrel (70) can be readily accomplished by withdrawing the mandrel through the central bore of metal insert 46 because this central bore has a diameter at least as large as the maximum external diameter of the mandrel, which corresponds to the maximum internal diameter of the tube 22. This relationship is best seen in FIG. 6, where the maximum internal diameter of tube 22 is shown equal in size to the diameter of the bore of insert 46. The portions of the tube ends illustrated in phantom are then cut off. After suitable machining to finish off the tube exterior, the tube is ready for assembly into the strut arrester.

It will be noted that, by virtue of the above-described construction of tube 22, the inserts are held securely captured in the tube ends in interference fit fashion. The essentially conical shape of insert 24, together with the extra tube material embracing the insert and beyond, provides a structure capable of withstanding tremendous tensile forces attempting to pull the insert from the tube. The greater length and crowned exterior surface of insert 46 achieve the same results at the other end of the tube. Since the end fittings threaded into the inserts have shoulders (e.g., 48*b*) that abut the ends of the tube, the tube itself effectively withstands the compressive forces on the strut arrester 18. While tube 22 is disclosed herein in its application to strut arrester 18, it will be appreciated that it can be utilized in other applications where high mechanical strength and long term resistance to deformation is desired.

It is thus seen that the objects set forth above, including those made apparent from the preceding description, are efficiently attained and, since certain changes may be made in the above description without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. A load bearing member having application in an aerial transmission line supporting insulator comprising:

A. an elongated tube formed of multiple convolutions of a continuous band of plural glass fiber strands and a resin bonding agent, said fiber band being wound in alternating oppositely directed helical winding patterns and an essentially circumferential winding pattern;

B. a metallic insert disposed within each open end of said tube, said inserts having uneven exterior surfaces over which said glass fiber convolutions extend to captivate said inserts within the tube ends in interference fit fashion, each of said inserts having a tapped central bore, and C. a metal end fitting in each of said inserts, each end fitting comprising a central portion with external threads thereon and a shoulder extending radially outward from said central portion, said central portion being threaded into the tapped central bore of its associated insert and having its shoulder abutting against an end wall of said tube to enable compressive forces on said load bearing member to be effectively transmitted through said shoulders to said tube, D. said central bore of one of said inserts having a diameter at least as great as the maximum inside diameter of said tube so that the mandrel on which said tube is wound can be readily removed from said tube through said bore after winding, thus leaving a space within the tube for the subsequent introduction of elements to be housed within said space.

2. The load bearing member defined in claim 1, wherein said convolutions of said helical winding patterns have a helix angle in the range of 10 to 50 degrees with respect to the tube axis.

3. The load bearing member defined in claim 2, wherein said convolutions of said circumferential winding pattern have a helix angle relative to the tube axis of 85 degrees or more.

4. The load bearing member defined in claim 3 wherein consecutive convolutions of said circumferential winding pattern are in slightly overlapping relation.

5. The load bearing member defined in claim 1, wherein said tube consists of alternating groups of at least two tube-end-to-tube-end continuous tubular layers of helically wound convolutions and at least one tube-end-to-tube-end continuous tubular layer of circumferentially wound convolutions.

6. The load bearing member defined in claim 5, wherein the innermost and outmost tubular layers of said tube are comprised of circumferentially wound convolutions.

7. The load bearing member defined in claim 1, wherein the uneven exterior surfaces of said inserts include exterior surface indentations in which said helically wound convolutions are lodged.

* * * * *